US005768717A

United States Patent [19]

Le Sueur

[11] Patent Number: 5,768,717

[45] Date of Patent: Jun. 23, 1998

[54] SEGMENTED SPINE PROTECTOR

[76] Inventor: Alexandra Catherine Le Sueur, Normanton House, Wilsford-cum-Lake, Salisbury, Wiltshire, SP4 7BJ, United Kingdom

[21] Appl. No.: 545,627

[22] PCT Filed: May 5, 1994

[86] PCT No.: PCT/GB94/00972

§ 371 Date: Jan. 22, 1996

§ 102(e) Date: Jan. 22, 1996

[87] PCT Pub. No.: WO94/24893

PCT Pub. Date: Nov. 10, 1994

[30] Foreign Application Priority Data

May 5, 1993 [GB] United Kingdom ..... 9309253

[51] Int. Cl.[6] ..... A41D 13/00

[52] U.S. Cl. ..... 2/467; 2/455

[58] Field of Search ..... 2/2, 44, 92, 455, 2/467; 602/18, 19, 20; 128/869, 870, 873, 874, 875, 846

[56] References Cited

U.S. PATENT DOCUMENTS 4,820,221 4/1989 Aubrey ..... 2/92
5,140,995 8/1992 Uhl ..... 2/92
5,328,447 7/1994 Kapounek et al. ..... 2/92
5,400,801 3/1995 Archer, III ..... 2/2

FOREIGN PATENT DOCUMENTS 0454402 10/1991 European Pat. Off. ..... 2/2
2249942 5/1992 United Kingdom ..... 2/2

*Primary Examiner*—C. D. Crowder
*Assistant Examiner*—Larry D. Worrell, Jr.
*Attorney, Agent, or Firm*—Ostrolenk, Faber, Gerb & Soffen, L.L.P.

[57] ABSTRACT

A spine protector comprising a garment formed of a stretch-type material to provide a close fit about the trunk of a wearer is disclosed, the garment including means for receiving and retaining an elongate segmented member in a position substantially along the median line of the dorsal panel of the garment, whereby the garment, when worm, holds the segmented member tightly against the spine of the wearer. The elongate segmented member comprises a generally linear array of segments configured so as to allow said member to flex in the manner of a human spinal column.

15 Claims, 5 Drawing Sheets

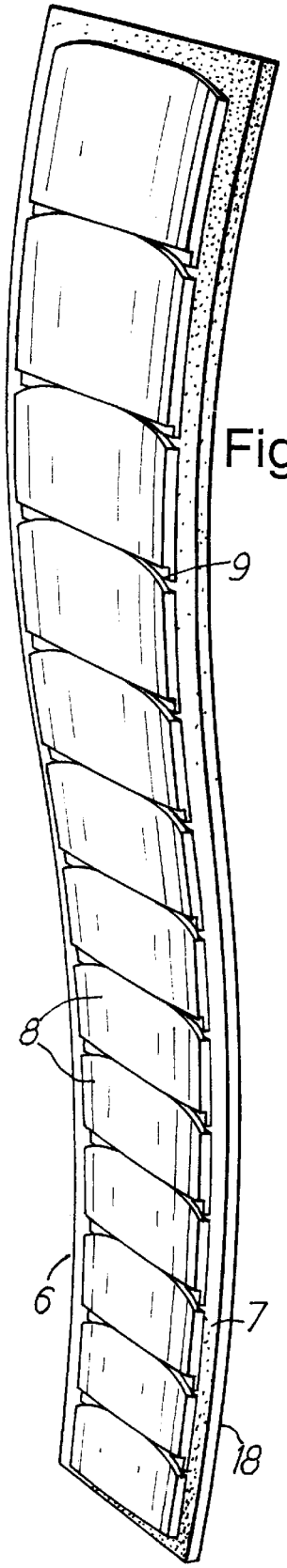
Fig.7
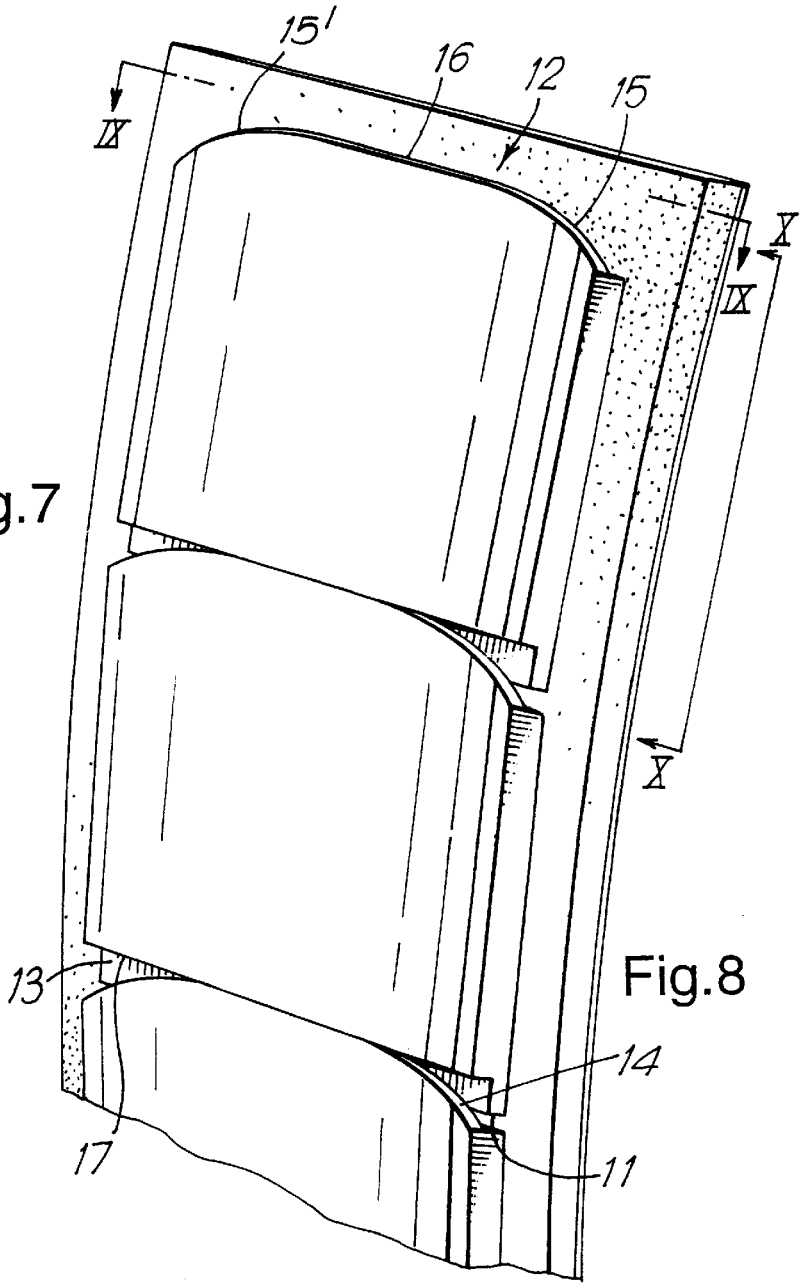
Fig.8
Fig.9
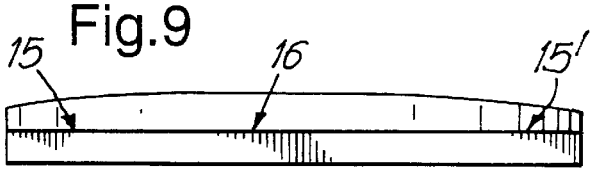
Fig.10
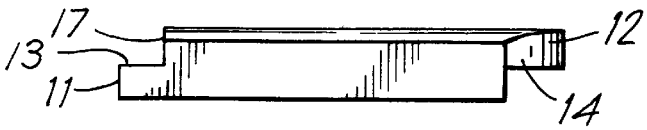

SEGMENTED SPINE PROTECTOR

BACKGROUND OF THE INVENTION

This invention relates to body protectors for use in sport and medicine, and more particularly, but not exclusively, relates to protection of the spinal column from trauma and excessive movement.

In many sports, particularly equestrian sports and other sports which place the participant in possibly perilous situations, such as motor cycle racing, there is a need to provide some form of protection in order to reduce the likelihood of serious injury to the participants in the event of an accident. In recent years, the wearing of protective headgear has become commonplace in a wide variety of hazardous sports and activities, and it is well-known that the incidence of cranial injuries resulting from accidents in such situations has consequently been much reduced. The acceptance of protective headgear by potential wearers has been greatly improved by advances in helmet design and construction, modern helmets being fabricated from lightweight yet resilient plastics materials which provide excellent protection while remaining comfortable and unobtrusive to wear.

Unfortunately, with regard to body protection, there is still a great reluctance on the part of sports participants to make use of existing body protection equipment. One of the reasons for this is that the presently available body protectors are unwieldy and cumbersome, and can restrict movement to such an extent that wearers may actually increase their risk of injury as a result of not being able to take evasive action in the event of an accident. One type of body protector currently available consists essentially of two rigid structures: one across the back, and the other protecting the front of the wearer. Two similarly rigid pieces protect each arm. These pieces are stitched into pockets in a zipped jacket, which is then additionally secured with a waist band. Since it has been customary hitherto to use protective panels which are rigid, little flexibility is allowed, and this can have very dangerous consequences in situations where a degree of flexibility is essential in order to prevent accidents and injury. This is particularly relevant in equestrian activities, where a wide range of movement is vital in order for the rider to stay safely mounted in a variety of situations. Furthermore, since some currently available body protectors are not fitted with a gusset, they have a tendency to ride up the body of a wearer, causing discomfort and reducing the protection afforded.

A body protector designed for motorcyclists is known from EP-A-0 436 788. This body protector comprises a number of identical segments mounted on a flexible base. Although the segments do allow a limited degree of flexibility, their primary purpose is to protect the spine of a wearer from impact damage by providing a foam-filled space between the spine and the exterior surface of each segment.

A similar type of body protector is disclosed in GB-A-2 249 942. This comprises a number of plate elements hinged to one another and attached to a flexible base. The plates are adapted so as to allow a wearer to bend forwards only. It is not possible for a wearer to bend backwards or sideways or to twist the body.

The human spine is remarkably flexible. The approximate maximal segmental contributions for a particularly supple person are shown below:

| | | |
|---|---|---|
| i) Lumbar level | Flexion | 60° |
| | Extension | 35° |
| | Lateral flexion | 20° |
| | Axial rotation | 5° |
| ii) Thoracic level | Flexion | 105° |
| | Extension | 60° |
| | Lateral flexion | 20° |
| | Axial rotation | 35° |
| iii) Cervical level | Flexion | 40° |
| | Extension | 75° |
| | Lateral flexion | 35° |
| | Axial rotational | 90° |

This flexibility must be considered in order to provide a body protector which is comfortable to wear.

SUMMARY OF THE INVENTION

According to a first aspect of the present invention, there is provided a segmented member comprising a generally linear array of segments, which member, in use, is held tightly against the spine of a wearer, wherein the upper and lower edges of each segment are stepped in a generally complementary manner so that the upper edge of one segment can cooperate with the stepped portion of the segment next above in the direction of the axis of the segmented member and so that the lower edge of said one segment can cooperate with the stepped portion of the segment next below it, characterised in that the segments are dimensioned so as to permit differing degrees of flexion and extension along the length of the segmented member such that the segmented member may flex in the manner of a human spinal column.

According to a second aspect of the present invention, there is provided a body protector comprising a garment formed of a stretch-type material to provide a close fit about the trunk of a wearer, the garment including means for receiving and retaining an elongate segmented member in accordance with the first aspect of the invention in a position substantially along the median line of the dorsal panel of the garment, whereby said garment, when worn, holds said segmented member tightly against the spine of the wearer Advantageously.

Advantageously, the garment is also adapted to receive resilient shielding panels or the like which, in use, will be held against the body of the wearer in order to afford additional protection against impact. In preferred embodiments, the garment is made of a durable elastic material, such as LYCRA® (Registered Trade Mark of DuPont), and may be provided with a zip or other type of fastening in order to allow the garment to be put on with relative ease. The garment is advantageously provided with a gusset in order to keep the garment in place relative to the body of the wearer. In order to enhance the fit of the garment, a waist band may additionally be fitted. This waist band, which may be provided with a velcro fastening means, will generally be made of the same material as the main body of the garment.

In preferred embodiments, the segments of the segmented member are mounted on a resilient base, and are provided with interfaces in order to allow limited relative movement between adjacent segments, thus providing a controlled degree of flexibility in the assembly of segments as a whole. The base is advantageously provided with a laminate on the side opposite to that on which the segments are mounted. This laminate is relatively harder to extend than to compress, and thus hinders over-extension of the segmented member while still allowing flexion. The resilient base may be fabricated from a material such as ethyl vinyl acetate foam. The segments may be rigid, or may be inherently resilient, as for example when fabricated from a resilient shock-absorbing material such as ethyl vinyl acetate foam; such a material is preferably coated with a hard outer skin of for example polypropylene, carbon fibre or the like.

Alternatively, at least one of the segments may comprise an outer shell which is filled with fluid to a required pressure. In this embodiment, each such segment may enclose a number of interconnected chambers in communication with each other, for example in the form of interconnected hexagonal cells. Such segments may be filled to different pressures in order to customise the fit of the segmented member to individual wearers, thereby enhancing comfort and safety by providing a close fit. Each such segment is advantageously provided with a valve allowing wearers to adjust the fluid pressure in the segments themselves. Suitable fluids include air, water and fluid polymeric materials, e.g. silicones.

The segments may be attached to the base by way of an adhesive such as neoprene contact spray adhesive.

Preferably, each segment is a generally rectangular lamella and is more rigid than the support onto which it is secured. For convenience, the geometry of the segments will be described herein in relation to their orientation in use, i.e when fitted over the spine of a person.

The upper and lower edges of each segment are preferably stepped in a generally complementary manner so that the upper edge of one segment can cooperate with the stepped portion of the segment next above in the direction of the axis of the segmented device, e.g. by overriding the step; and so that the lower edge of said one segment can cooperate with the stepped portion of the segment next below it; this arrangement generates limited flexibility within a vertical plane passing through the axis of the segmented member and orthogonal to the plane of the lamellae. Conveniently, the stepped portion at the lower edge of each segment provides a basal surface over which the undercut portion of the upper edge of the segment next below it can ride. The overhanging section of the segment, generally at the upper edge of the segment, is preferably curved with a mean radius of curvature which is large relative to the axial height of the segment; in this way it is possible for adjacent segments to pivot slightly against one another, thus generating limited flexibility in a plane passing through the axis of the segmented member and containing the plane of the lamellae. The adoption of a relatively rigid series of lamellar segments mounted on a relatively resilient support provides a limited degree of flexibility helically about the axis of the segmented member.

By shaping and sizing the segments in an appropriate manner, the segmented member is capable of flexing and extending in the manner of a human spine, but the limits of the flexion and extension are controlled and are generally arranged to be less than those of a natural human spine. This means that when the segmented member is inserted into the body protector garment, the spine of the wearer is protected from movement beyond its natural range of flexion and extension, and consequently the risk of spinal column injury is diminished. By making the segments out of a tough and resilient material, the segmented member may also protect against trauma injuries caused by impact.

In certain embodiments, the segments are adjustable in size, allowing one size of body protector to fit a range of wearers.

Preferably, the dimensions of the lamellar segments, and in particular their height (i.e. in the direction of the axis of the spine) are selected to permit greater flexibility in the middle region of the segmented member (and therefore the spine of the wearer) than in the upper and lower regions thereof.

BRIEF DESCRIPTION OF THE DRAWINGS

For a better understanding of the present inventions and in order to show how the same may be carried into effect, reference shall now be made, by way of example, to the accompanying drawings, in which:

FIG. 7 is a perspective view of a preferred embodiment of spine protector constructed in accordance with the principles of FIGS. 5 and 6;

FIG. 8 is an enlarged view of the upper portion of the spine protector of FIG. 7;

FIG. 9 is a schematic side elevation of one of the upper segments, seen in the direction of arrows IX—IX of FIG. 8; and FIG. 10 is a schematic end elevation of one of the upper segments, seen in the direction of arrows X—X of FIG. 8.

DESCRIPTION OF THE PREFERRED EMBODIMENTS

Figure 1:
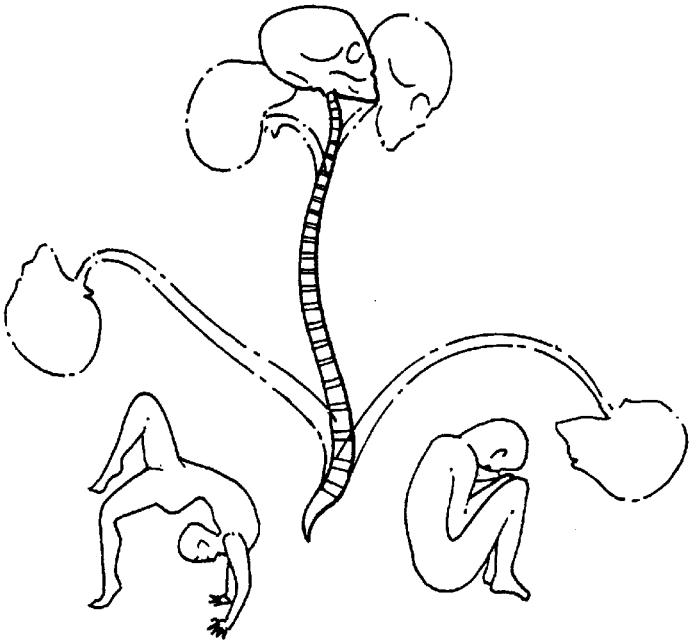
FIG. 1 shows the range of flexion and extension of the vertebral column.
Figure 2:
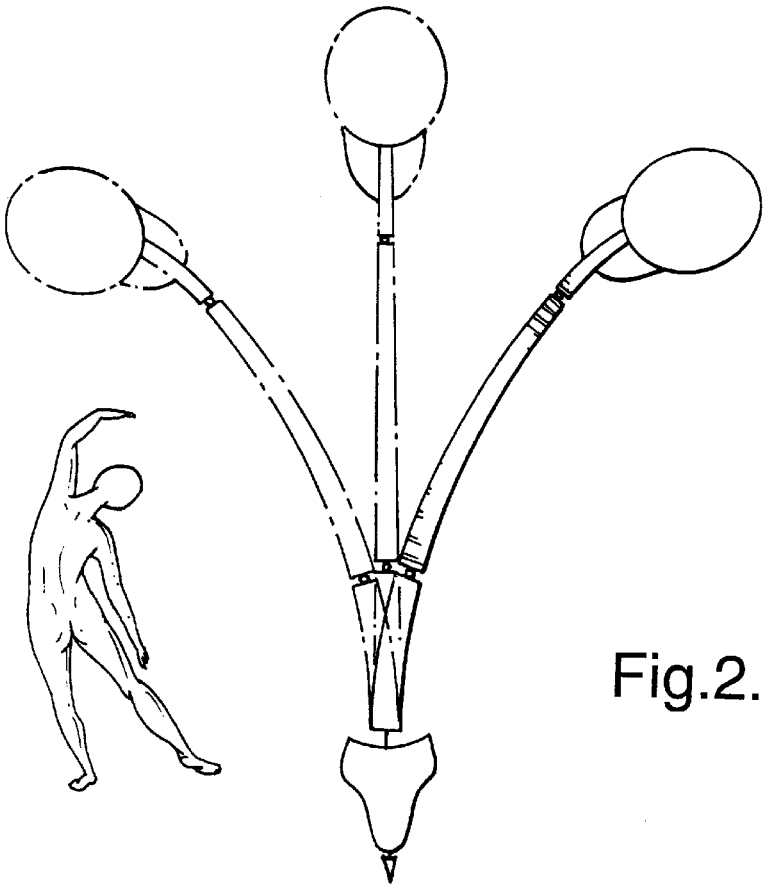
FIG. 2 shows the range of lateral flexion of the vertebral column.

With regard to FIGS. 1 and 2, it is apparent that the range of movement of the human spine is very extensive. Consequently, for a body protector to be comfortable to wear, it must allow a sufficiently wide range of movement. However, if the spine is forced to flex or extend beyond its natural range, serious injury is likely to result. It is therefore desirable for a body protector to prevent movement of the spine beyond these natural limits.

Figure 3:
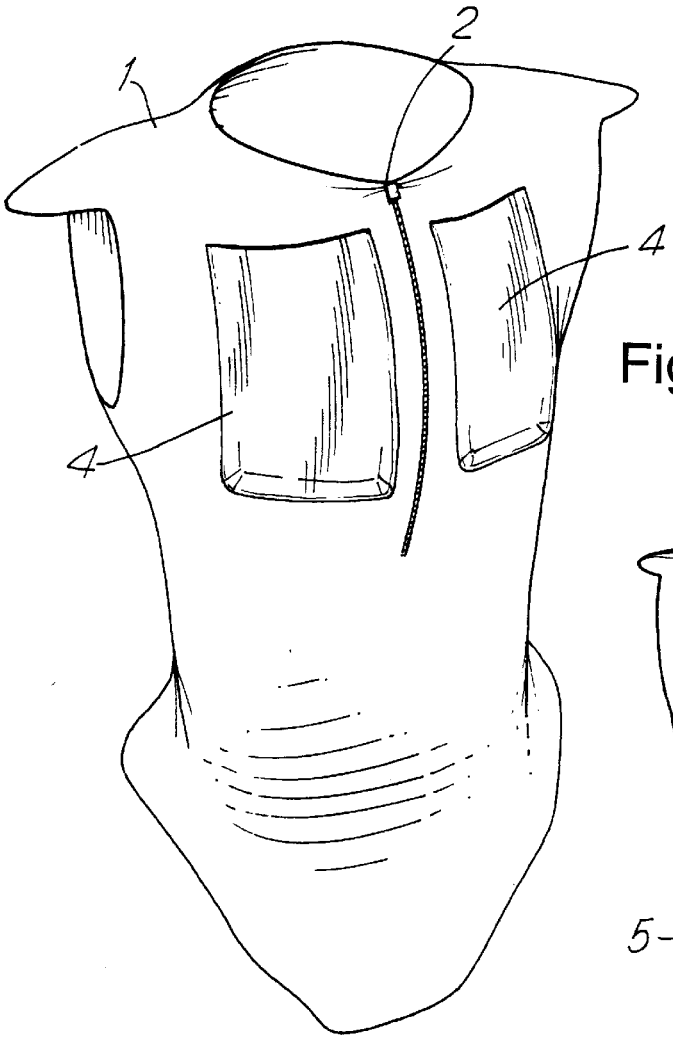
FIG. 3 is a front perspective view of a preferred body protector according to the present invention.
Figure 4:
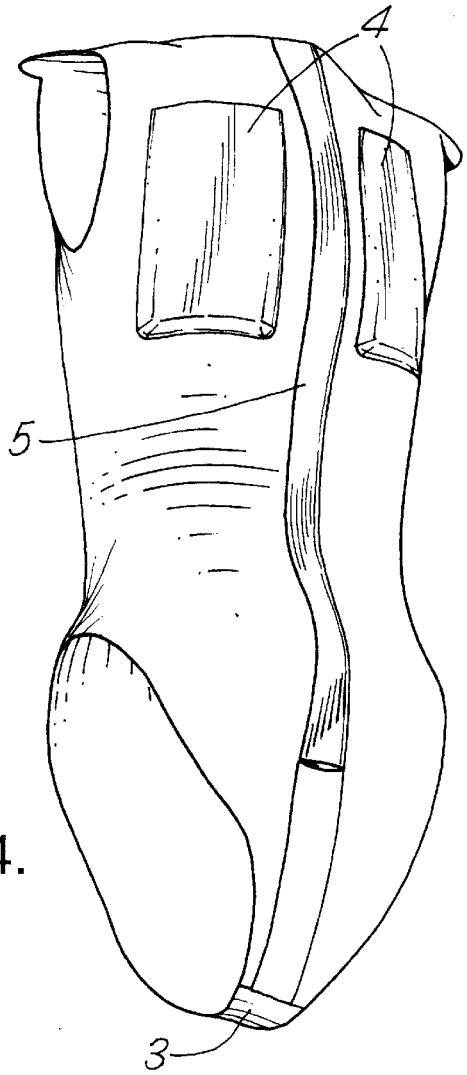
FIG. 4 is a rear perspective view of the body protector of FIG. 3.

FIGS. 3 and 4 show a body stocking-type garment 1, which is made of a synthetic polymer yarn, e.g. LYCRA® (Registered Trade Mark of DuPont). The garment 1 is provided with a zip fastener 2, and has a gusset 3 which prevents the garment from riding up the body of the wearer when in use Pockets 4 are provided to receive protective panels (not shown), and pocket S is provided to receive the segmented spine protector of FIGS. 5 to 7.

Figure 5:
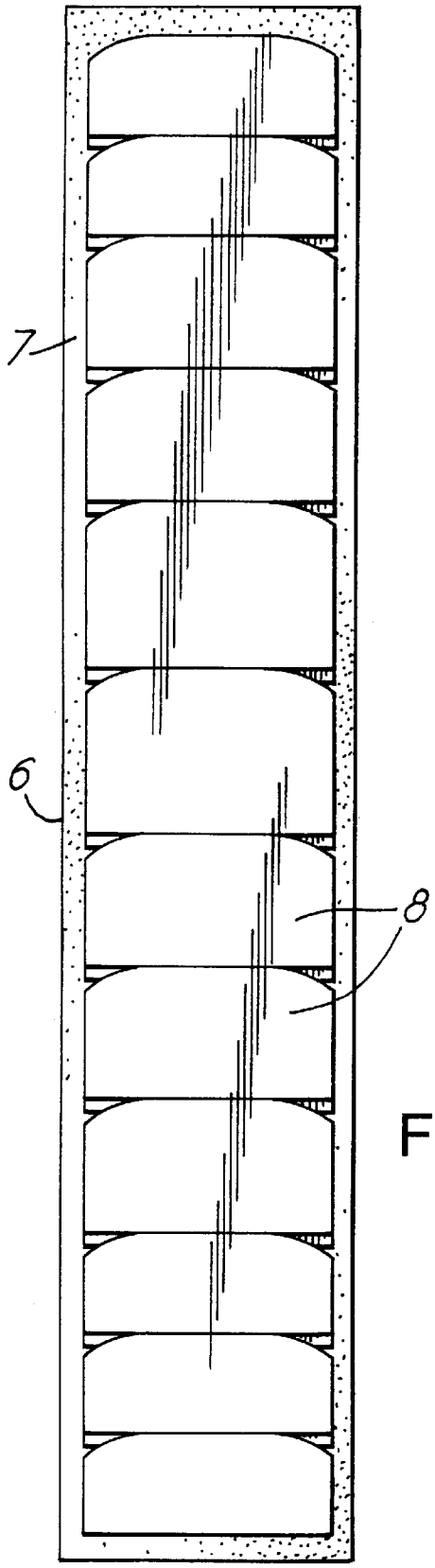
FIG. 5 is a schematic plan view of a segmented spine protector according to the present intention.
Figure 6:
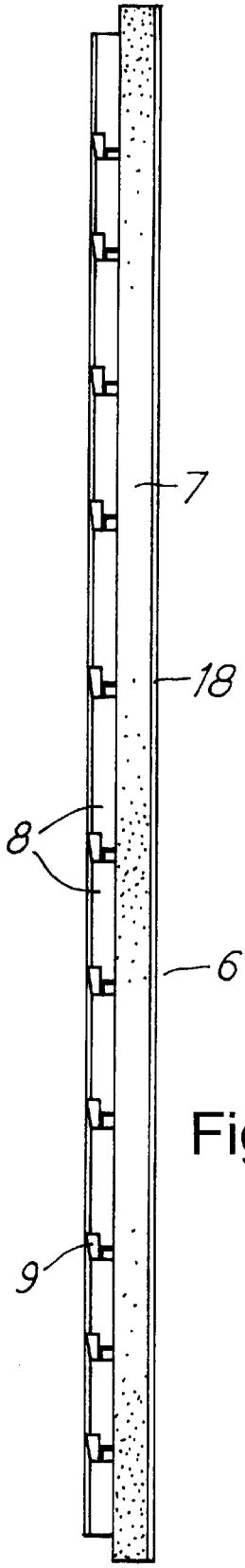
FIG. 6 is a side elevation of the spine protector of FIG. 5.

FIGS. 5 and 6 show schematically a spine protector 6 comprising a resilient foam base 7, provided with a laminate 18 on one side, and bearing segments 8 on the other. Each of the segments 8 is in the form of a generally rectangular lamella having stepped upper and lower edges, the step at the lower edge being overcut and that at the upper edge being undercut.

The segments 8 are sized and shaped in the manner shown which, by mimicking the relative sizes of the vertebrae of a human spine, allows the spine protector to flex and extend to the required degree, which will be just less than the natural limits of the human spine. The segments 8 abut one another at interfaces 9, which, along with the laminate 18, allow the spine protector to achieve a positive degree of curvature with ease, yet prevent an excessive degree of negative curvature.

FIG. 7 shows a perspective view of a preferred spine protector 6, constructed generally as indicated in FIGS. 5 and 6, in which the effect of the differently sized segments 8 in shaping the protector in the manner of a human spine can be seen.

FIG. 8 is an enlarged view of the upper part of the spine protector of FIG. 7. Taken together with the schematic views of FIGS. 9 and 10, the geometry of the individual segments in the presently preferred embodiment can better be appreciated.

The lower edge 11 of each segment is an overcut step section, and the upper edge 12 is an undercut step section. Stepped edge 11 provides a basal surface 13 over which portion 14 of the adjacent segment can ride (see FIG. 10. The edge 12 is curved as can be seen from FIGS. 7 and 8; the mean radius of curvature of the edge of step 14 is large compared to the axial height of the segment. It is also apparent that the curvature is greater at the Outer regions 15, 15' than at the central region 16. The thickness of the segment (i.e. perpendicular to the plane of the lamella) also varies across its width, as seen from FIGS. 8 and 9. The end face 17 of the overcut step portion 11 is linear.

Figure 11:
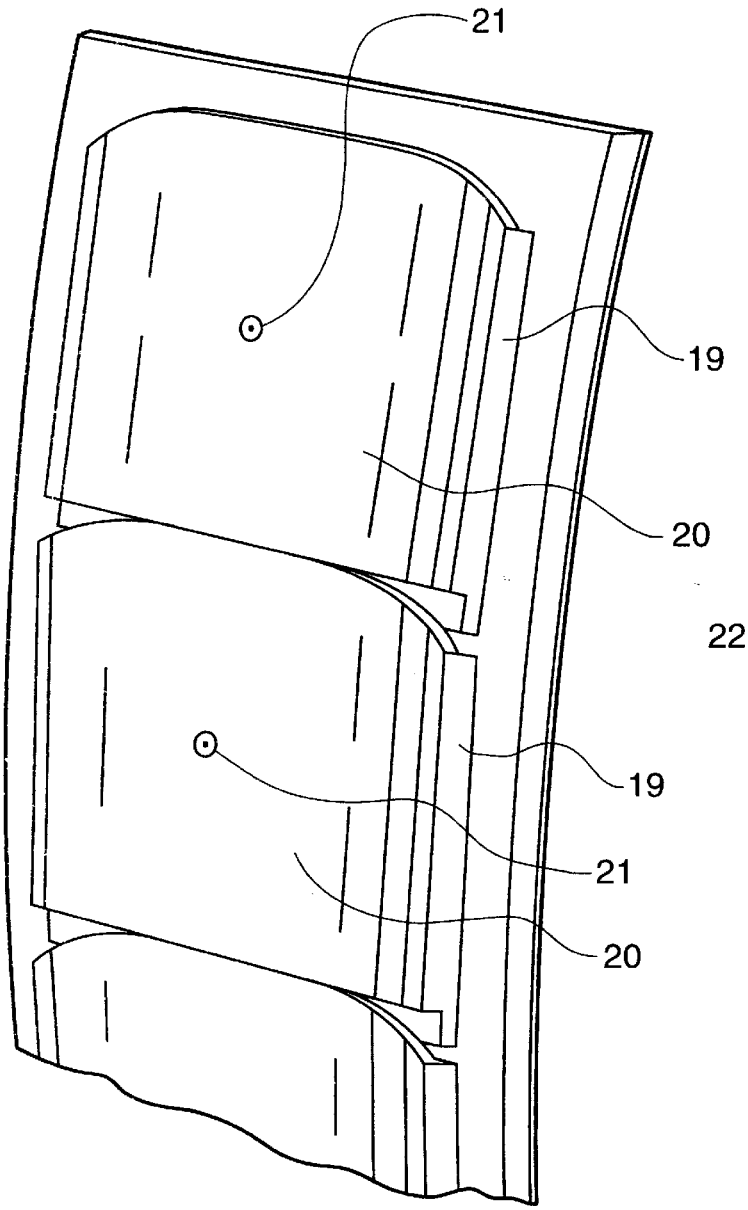
FIG. 11 is a perspective view of an alternative embodiment of the spine protector according to the present invention.
Figure 12:
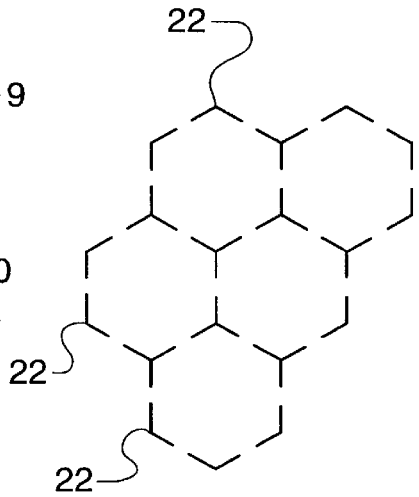
FIG. 12 is a schematic view of the interior segments of the spine protector of FIG. 11.

FIG. 11 shows an alternative embodiment of the present invention, in which segments 9 comprise an outer shell 20 which is filled with fluid to a required pressure. Each segment 19 is provided with a valve 21 which allows the fluid pressure in the segment 19 to be adjusted. As shown in FIG. 12, the interior of each segment 19 may comprise a number of interconnected chambers, such as hexagonal cells 22, in fluid communication with each other.

Although the body protector of the present invention has been described with reference to sports protection, it is envisaged that the invention will find application in many other fields, such as orthopaedic surgery and the rehabilitation of victims of spinal column injury, where spinal support and protection are needed.

I claim:

1. A segmented member for use as a spine protector when held tightly against the spine of a wearer, comprising:

a generally linear array of segments arranged along an axis;

each segment having an upper edge and a lower edge and having a height defined as the spacing between the upper and lower edges;

the upper and lower edges of each segment being stepped in a generally complementary manner so that the upper edge of one segment can mesh with the lower edge of a segment next above along the axis and so that the lower edge of said one segment can mesh with the upper edge of a segment next below along the axis; wherein the segments and the upper and lower edges of the segments are dimensioned so as to permit differing degrees of flexion and extension along the axis of the segmented member such that the segmented member may flex in the manner of a human spinal column.

2. A segmented member as claimed in claim 1, wherein the lower edge of each segment includes a basal surface over which an overhanging portion of the upper edge of the segment next below it can ride.

3. A segmented member as claimed in claim 2, wherein the overhanging portion is curved with a mean radius of curvature which is larger than the height of the segment.

4. A segmented member as claimed in claim 1, wherein the segments are mounted on a resilient base.

5. A segmented member as claimed in claim 4, wherein the base is provided with a laminate on a side opposite to that on which the segments are attached, and which laminate is harder to extend than to compress.

6. A segmented member as claimed in claim 1, wherein the segmented member has an upper, a middle, and a lower region and the segments and the upper and lower edges are dimensioned so as to permit greater flexibility in the middle region than in the upper and lower regions.

7. A segmented member as claimed in claim 1, wherein at least one of the segments comprises a resilient shock-absorbing material coated with a hard outer skin.

8. A segmented member as claimed in claim 1, wherein at least one of the segments comprises an outer shell which is filled with fluid to a predetermined pressure.

9. A segmented member as claimed in claim 8, wherein said outer shell encloses a plurality of intercommunicating chambers.

10. A segmented member as claimed in claim 8, wherein said at least one segment is provided with a valve allowing control of the fluid pressure in the segment.

11. A spine protector comprising a garment formed of a stretch-type material to provide a close fit about the trunk of a wearer, the garment having a dorsal panel and an elongate segmented member as claimed in claim 1 which is received and retained in a position substantially along a median line of the dorsal panel of the garment, whereby said garment, when worn, holds said segmented member tightly against the spine of the wearer.

12. A spine protector as claimed in claim 11, wherein the garment is additionally provided with means for receiving resilient shielding panels.

13. A spine protector as claimed in claim 11, wherein the garment is provided with a gusset.

14. A segmented member for use as a spine protector when held tightly against the spine of a wearer, comprising:

a generally linear array of segments arranged along an axis and mounted on a resilient base;

the base being provided with a laminate on a side opposite to that on which the segments are attached, the laminate being harder to extend than to compress;

each segment having an upper edge and a lower edge and having a height defined as the spacing between the upper and lower edges;

the upper and lower edges of each segment being stepped in a generally complementary manner so that the upper edge of one segment can mesh with the lower edge of a segment next above along the axis and so that the lower edge of said one segment can mesh with the upper edge of a segment next below along the axis;

wherein the segments and the upper and lower edges of the segments are dimensioned so as to permit differing degrees of flexion and extension along the axis of the segmented member such that the segmented member may flex in the manner of a human spinal column.

15. A spine protector comprising a garment formed of a stretch-type material to provide a close fit about the trunk of a wearer, the garment having a dorsal panel and an elongate segmented member as claimed in claim 14 which is received and retained in a position substantially along a median line of the dorsal panel of the garment, whereby said garment, when worn, holds said segmented member tightly against the spine of the wearer.

* * * * *